United States Patent [19]

Zulauf

[11] Patent Number: 4,585,149

[45] Date of Patent: Apr. 29, 1986

[54] DOUBLE CONTAINER FOR TWO SEPARATED FLUIDS

[75] Inventor: Karl H. Zulauf, Höchst-Hassenroth, Fed. Rep. of Germany

[73] Assignee: Wella Aktiengesellschaft, Darmstadt, Fed. Rep. of Germany

[21] Appl. No.: 544,000

[22] Filed: Oct. 20, 1983

[30] Foreign Application Priority Data

Oct. 27, 1982 [DE] Fed. Rep. of Germany ..... 3239784

[51] Int. Cl.[4] ..... B65D 35/22

[52] U.S. Cl. ..... 222/94; 222/144.5

[58] Field of Search ..... 222/94, 545, 553, 548, 222/145, 144.5, 129, 142.5, 142.6, 142.7

[56] References Cited

U.S. PATENT DOCUMENTS

| | | | |
|---|---|---|---|
| 2,578,538 | 12/1951 | Gray | 222/142.5 |
| 3,003,665 | 10/1961 | Peters | 222/94 |
| 3,157,315 | 11/1964 | Bianco | 222/142.5 |
| 3,200,995 | 8/1965 | Gangwisch | 222/94 |
| 3,206,074 | 9/1965 | Hoffmann | 222/74 |
| 3,405,850 | 10/1968 | Esposito, Jr. | 222/548 |

FOREIGN PATENT DOCUMENTS

| | | | |
|---|---|---|---|
| 2826887 | 1/1979 | Fed. Rep. of Germany . | |
| 1138690 | 1/1969 | United Kingdom | 222/144.5 |
| 1576126 | 10/1980 | United Kingdom | 222/548 |

*Primary Examiner*—Joseph J. Rolla
*Assistant Examiner*—Kenneth Noland
*Attorney, Agent, or Firm*—Michael J. Striker

[57] ABSTRACT

A double container consisting of elastic plastic material has an inner container and an outer container as well as a turning lock which includes an outer locking part and an inner locking part. The inner container is arranged within the outer container whereby the inner locking part of the turning lock is screwed to both containers. The outer locking part is connected with the inner locking part via a snap connection and is pivotally arranged thereon. The inner locking part is provided with outlet openings which are selectively closeable by blocking members at the lower end of the outlet nozzle which is connected to the outer locking part. Upon manual pressing of the outer container, the fluid contained in the inner container or the fluid contained in the outer container can be discharged. Also a mixing of both fluids is possible during the emptying when the outlet openings are only partly closed.

24 Claims, 7 Drawing Figures

DOUBLE CONTAINER FOR TWO SEPARATED FLUIDS

BACKGROUND OF THE INVENTION

The present invention relates to a double container for two separated fluids.

In general, such double containers include an inner container which is surrounded by an outer container and with an outlet nozzle for both containers as well as with a lock.

For the discharge of the two different fluids, it is known to use two separated containers which are combined to a structural unit and which are provided with a common lock. In DE-OS No. 2,826,887 this lock is formed as dosaging valve so that two fluids kept in separated containers can be mixed in a certain ratio and can be discharged. The valve housing of the dosaging valve has a shape stable valve body which is provided with outlet lines and is movably supported within the housing by an actuating member. The valve housing rests on a valve cover with a sealing shoulder that is fixed to an opening of a pressure container by means of the valve cover. Within the pressure container, a propellant is located as pressure generator. Furthermore, the valve housing is provided with an inner housing part on whose inner wall superposing sealing webs and through openings are arranged. The valve body has a shaft and flanges perpendicular thereto and forms for each sealing web having two sealing surfaces, a respective sealing support surface at the shaft and at the flange between which outlet openings of the shaft are provided in the closing position of the valve. On the valve housing, two connecting parts are coupled with a fluid container by fixing means.

The apparatus according to the DE-OS No. 2,826,887 has the disadvantage of a very complicated structure which renders it susceptible to troubles. Moreover, this prior art reference necessitates considerable space and is complicated to handle. The considerable demand for space is primarily based on the fact that the valve is actuated by pressing the valve body. Consequently upon actuation, the valve body is moved upwardly and downwardly in direction of the container axis so that considerable space is needed in axial direction.

SUMMARY OF THE INVENTION

It is a general object of the present invention to avoid the prior art disadvantages.

In particular, it is an object of the present invention to provide a double container for two fluids which necessitates a minimum of space and is easy to operate.

A concommitant object of the present invention is to provide a double container for two separated fluids which is simple in construction, reliable in operation and inexpensive nevertheless.

In keeping with these objects and with others which will become apparent hereinafter, one feature of the present resides in a double container for two fluids, comprising an outer container defining an interior and accommodating a first fluid, an inner container located in the interior of the outer container and accommodating a second fluid, an outlet nozzle being selectively in communication with the inner and outer containers, and means for selectively locking the access from the inner and outer containers to the outlet nozzle and including an inner locking part arranged on the outer container and connected to the inner container, and an outer locking part connected to the outlet nozzle and pivotally arranged on the inner locking part which accommodates at least one opening communicating with the outer container and at least one further opening communicating with the inner container, so that upon rotation of the outer locking part with respect to the inner locking part, the first and second fluids are selectively discharged through the associated opening. The inventive double container for two fluids has the advantage of its simple and space saving structure. The double container has only a few and simply designed individual parts which can be assembled in an easy manner so that any commercial mass production is possible and a high operating reliability is achieved.

In a preferred embodiment of the invention, the double container is provided with two openings opposing each other and in communication with the outer container and with two further openings which also oppose each other and are in communication with the inner container. Through the provision of two opposing blocking members which are connected to the outer locking part, the fluids can selectively be discharged through the outlet nozzle either individually or in any arbitrary mixture.

Preferably the inner locking part and the outer locking part are connected to each other via a snap connection which allows a rotational movement of the outer locking part with respect to the inner locking part and prevents in a reliable and economical manner a movement in axial direction of the container.

According to another feature of the present invention, it is suitable that the volume ratio of the inner container and the outer container does not exceed the value of 1 to 2. Preferable ratios are 1 to 3, 1 to 4, and 1 to 5.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
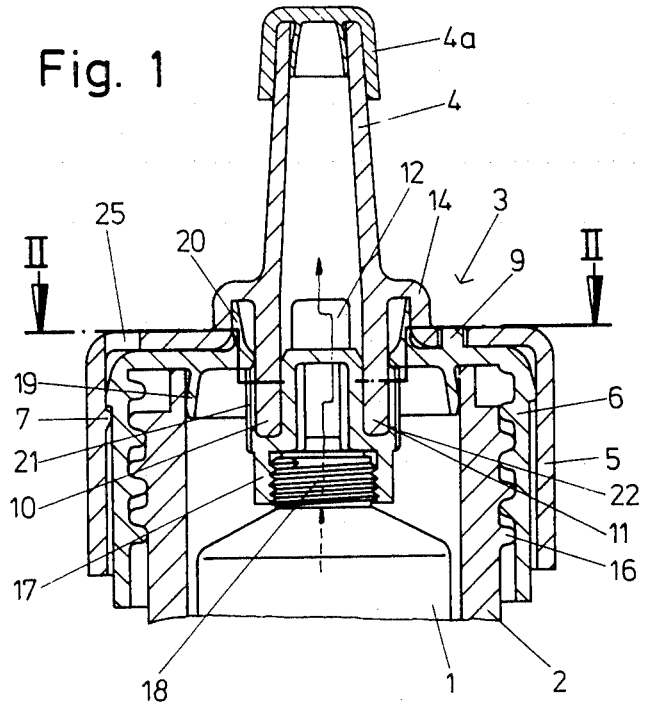
FIG. 1 is a longitudinal section along the line I—I in FIG. 2 through a double container according to the invention, showing a turning lock opened for the inner container.

The double container includes an inner container 1 which accommodates a first fluid and is surrounded by an outer container 2 which contains a second fluid. For selectively discharging the fluids from the inner and outer containers a turning lock 3 which is provided with an outlet nozzle 4 is arranged. As especially shown in FIGS. 6 and 7, the inner container 1 is tube-shaped or balloon-shaped.

The turning lock 3 has a cup-shaped outer locking part 5 which is pivotally arranged on a cup-shaped inner locking part 6. Both locking parts 5, 6 are connected with each other by a snap connection which is obtained through cooperation between a projection 7 arranged on the outer locking part 5 and inwardly directed, on the one hand, and a shoulder 7*a* defined by the inner locking part, on the other hand.

The outer locking part 5 is provided with a slot 8 of circular sector shape in which a stop member 9 projects. The stop member 9 is fixed to the inner locking part 6 so that the rotational movement between the locking parts 5, 6 is limited. The outlet nozzle 4 is fixed to the outer locking part 5 and is provided at its lower portion with two opposing locking members 10, 11 between which, free intermediate spaces 12, 13 are defined. As can be seen for example from FIG. 1, the outlet nozzle is further provided with an annular extension 14. The free intermediate spaces 12, 13 constitute inlet openings for the fluid into the outlet nozzle 4.

The inner locking part 6 is provided at its upper portion with an internal thread 16*a* which cooperates with an external thread 16 in the upper portion of the outer container 2. The inner locking part 6 is further provided with a prolongation 17 projecting inwardly in direction to the interior of the outer container. The prolongation 17 is provided with an internal thread 18*a* for cooperation with an external thread 18 at the top portion of the inner container 1. For sealing the outer container 2 towards the outside, a circular sealing lip 19 is arranged projecting towards the interior of the outer container 2 and abutting thereagainst. A further sealing lip 20 projects into the extension 14 at the outlet nozzle 4 for sealing the outer and inner locking parts 5, 6 against each other.

Accommodated within the prolongation 17, two opposing outlet openings 21, 22 are arranged for the fluid contained in the outer container 2 and two opposing outlet openings 23, 24 for the fluid contained in the inner container 1. At the edge of the outer locking part 5 three breakthroughs 25 (see FIGS. 2 and 4) are located which are formed on manufacturing grounds in view of the three underlying cams of the snap connections 7, 7*a* in order to be able to remove the outer locking part from the die after the molding.

As can be further seen from FIG. 1, the outlet nozzle 4 is closeable by a plug-in closing cap 4*a*. It is, however, conceivable to use also a breakaway or screw lock.

Figure 2:
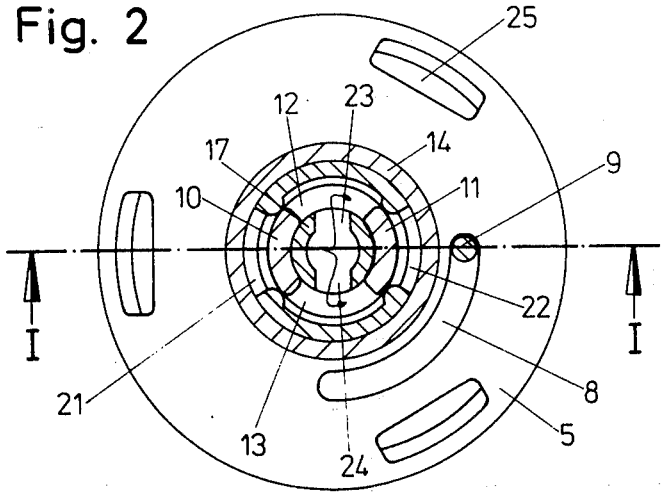
FIG. 2 is a sectional view along the line II—II according to FIG. 1.
Figure 3:
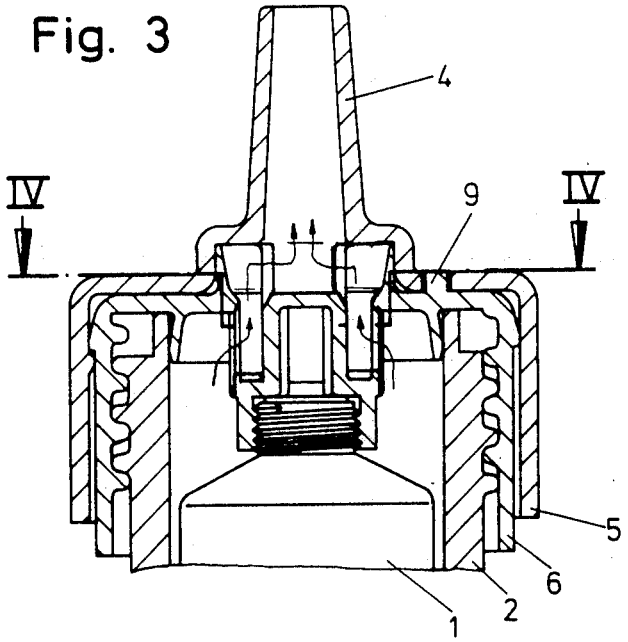
FIG. 3 is a longitudinal section along the line III—III in FIG. 4 through the double container, showing the turning lock opened for the outer container.
Figure 4:
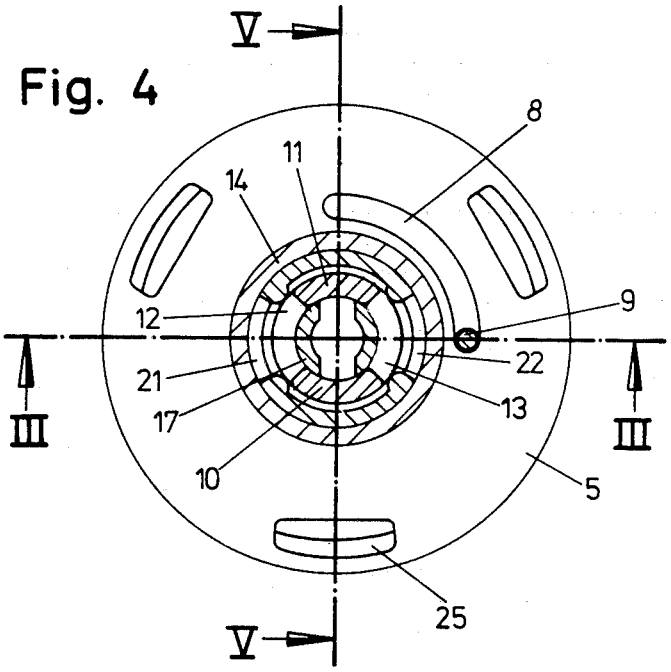
FIG. 4 is a sectional view along the line IV-IV according to FIG. .3.
Figure 5:
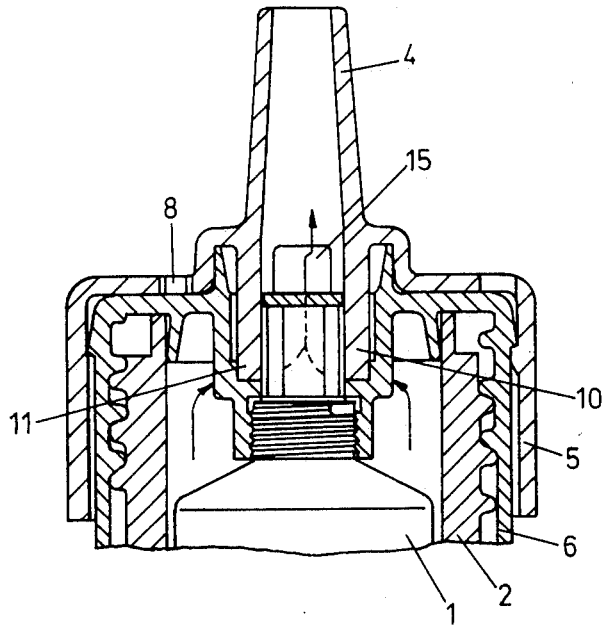
FIG. 5 is a longitudinal section along the line V—V according to FIG. 4.
Figure 6:
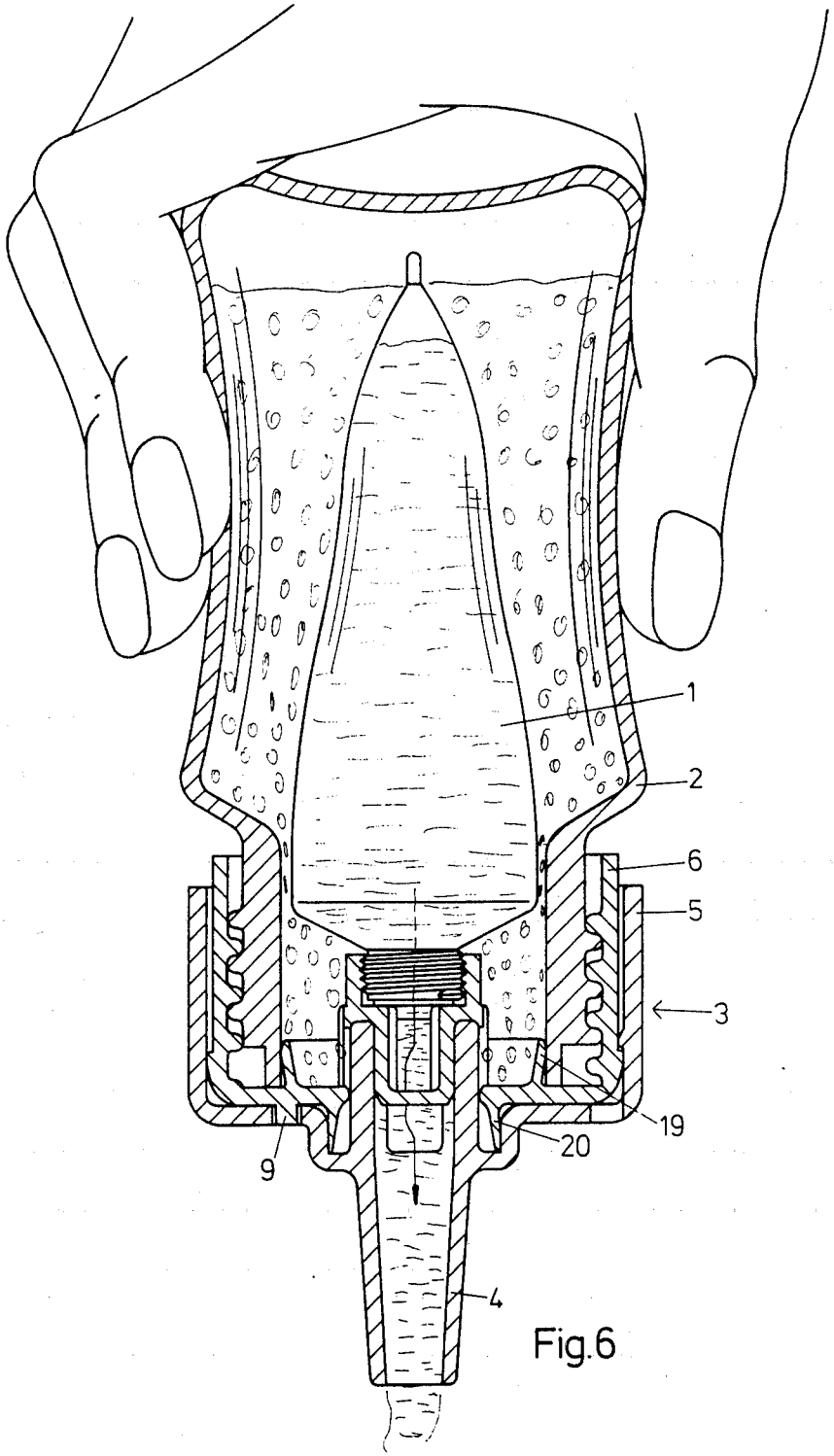
FIG. 6 is a longitudinal section through the double container in a position of use wherein the turning lock is opened for the fluid contained in the inner container.
Figure 7:
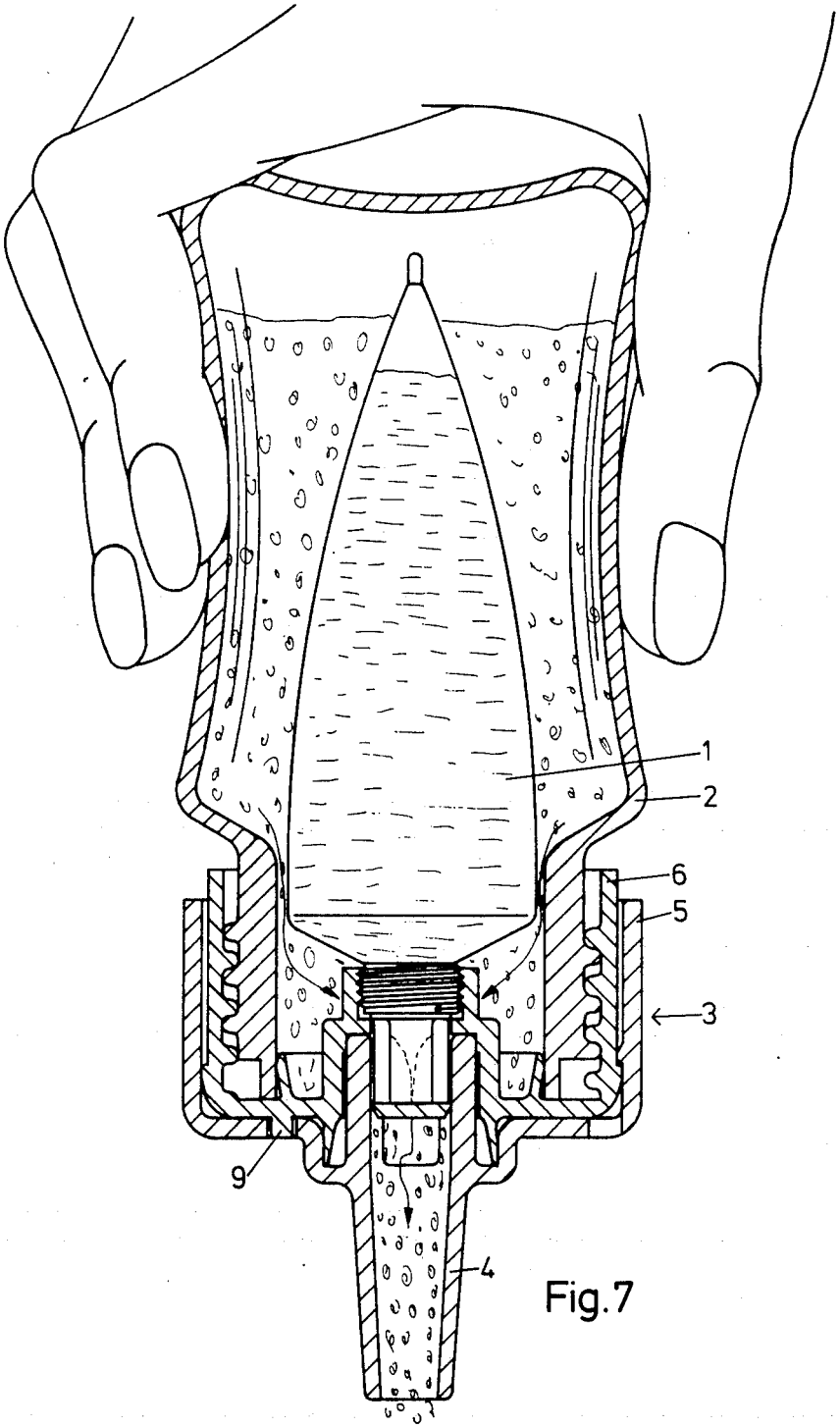
FIG. 7 is a longitudinal section through the double container according to FIG. 6, wherein the turning lock is opened for the fluid contained in the outer container.

In the position of the outer locking part 5 according to FIGS. 1 and 2, the locking members 10, 11 seal the outlet openings 21, 22 so that upon manual pressing of the outer container 2, the fluid contained in the inner container 1 can be discharged through the openings 23, 24 and out of the outlet nozzle 4 when bringing the double container in the position of use as can be seen from FIG. 6. Upon rotation of the outer locking part 5 about 90° so that the stop member 9 abuts the other end of the slot 8, and the locking part 5 is in the position shown in FIGS. 3 to 5, the outlet openings 21, 22 are open while the outlet openings 23, 24 are closed by the locking members 10, 11. In this case, the fluid contained in the outer container 2 is discharged through the outlet nozzle 4 as shown in FIG. 7. In both end positions of the outer locking part 5 either the outer container 2 or the inner container 1 is closed, so that only the inner container or the outer container can be emptied as this is indicated by arrows in the Figures. In case, however, the outer locking part 5 occupies intermediate positions between the positions as shown in FIGS. 2 and 4 then both fluids contained in the container 1, 2 can be mixed with each other in a ratio depending on the position of the outer locking part 5.

In order to guarantee the operation of the double container, the inner and outer container 5, 6 must be adjusted to each other in their volume so that the other container 2 can be pressed for emptying of both fluids without contacting of the wall of the inner surface of the outer container with the wall of the outer surface of the inner container. This is necessary because the inner container 1 cannot or can only slightly be deformed due to the sealed outlet openings 23, 24. Consequently it is suitable to provide the volume ratio of both containers at most 1 to 2. Preferred ratios are 1 to 3, 1 to 4, and 1 to 5.

It is to be understood that the invention is not limited to the above described embodiment and as shown in the drawing. Certainly, instead of fluids, the container can also be filled with pasty substances. For example, in the inner container 1 a shampoo can be filled, while in the outer container 1 a conditioning agent for the hair treatment is provided so that at first the shampoo and then the conditioning agent can be discharged.

The double container is made of elastic material and all its parts can be modeled by plastic material.

It is further noted that the connection between the inner locking part 6 with the containers 1, 2 can also be provided via rotation fixed snap connections instead of the connections via internal and external threads as described.

It will be understood that each of the elements described above, or two or more together, may also find a useful application in other types of double containers for two fluids differing from the types described above.

While the invention has been illustrated and described as embodied in a double container for two fluids, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A double container for two fluids, comprising an outer container defining an interior and accomodating a first fluid; an inner container located in the interior of the outer container and accomodating a second fluid; an outlet nozzle being selectively in communication with the inner and outer containers; and means for selectively locking the access from the inner and outer containers to the outlet nozzle and including an inner locking part aranged on the outer container and being connected to the inner container, and an outer locking part connected to the outlet nozzle and pivotally arranged on the inner locking part which accommodates at least one opening communicating with the outer container and at least one further opening communicating with the inner container, so that upon rotation of the outer locking part with respect to the inner locking part, the first and second fluid are selectively discharged through the associated opening, said outer locking part being provided with at least one blocking member for selectively sealing off said at least one opening and said at least one further opening, said inner locking part being provided with a prolongation projecting into the interior of the outer container and connected to the inner container, said prolongation accommodating the openings.

2. A double container as defined in claim 1, wherein the locking means are arranged so that the first and the second fluids are individually discharged.

3. A double container as defined in claim 1, wherein the locking means are arranged so that the first and the second fluids are discharged in any arbitrary ratio.

4. A double container as defined in claim 1, wherein the inner container, the outer container, the outlet nozzle, and the locking means are made of a plastic material

5. A double container as defined in claim 1, wherein the inner container, the outer container, the outlet nozzle and the locking means are made of an elastic material.

6. A double container as defined in claim 1, wherein the locking means is formed as a turning lock.

7. A double container as defined in claim 1, wherein the prolongation accommodates two such openings opposing each other and communicating with the outer container and two further such openings opposing each other and communicating with the inner container.

8. A double container as defined in claim 1, wherein the outer locking member is provided with two such blocking members opposing each other.

9. A double container as defined in claim 8, wherein the blocking members are integrally connected to the outlet nozzle and define respective intermediate spaces with the adjacent prolongation for allowing passage of the first and the second fluid.

10. A double container as defined in claim 1, wherein the inner and outer locking parts are cap-shaped.

11. A double container as defined in claim 1, wherein the outer locking part is provided with a slot, the inner outlet locking part having a stop member projecting into the slot of the outer locking part for limiting the rotational movement of the outer locking part with respect to the inner locking part.

12. A double container as defined in claim 11, wherein the slot is of a circular sector shape.

13. A double container as defined in claim 1, wherein the outer locking part is provided with an inwardly extending projection and the inner locking part is provided with a shoulder cooperating with a projection to form a snap connection between the inner locking part and the outer locking part.

14. A double container as defined in claim 1, wherein the inner locking part is formed so as to be releasably connected with the outer container and the inner container.

15. A double container as defined in claim 14, wherein the inner locking part is connected to the inner and the outer container via a rotational-fixed snap connection.

16. A double container as defined in claim 14, wherein the inner locking part is provided with an internal thread and the outer container is provided with an external thread so as to connect the inner locking part with the outer container.

17. A double container as defined in claim 1, wherein the prolongation is provided with an internal thread and the inner container is provided with an external thread so as to connect the inner locking part with the inner container.

18. A double container as defined in claim 1, wherein the inner locking part has an annular sealing lip for sealing the upper end of the outer container against the outside.

19. A double container as defined in claim 1, wherein the inner locking part has an annular sealing lip for sealing the inner locking part against the outer locking part.

20. A double container as defined in claim 19, wherein the outlet nozzle is provided with an annular extension, the annular sealing lip projecting into the annular extension.

21. A double container as defined in claim 1, wherein the inner container is tube-shaped.

22. A double container as defined in claim 1, wherein the inner container is balloon-shaped.

23. A double container as defined in claim 1; and further comprising a removable closing cap, the outlet nozzle being closeable by the removable closing cap.

24. A double container as defined in claim 1, wherein the inner container has a volume and the outer container has a volume, the volume ratio of the inner container to the outer container is at most 1 to 2.

* * * * *